US007059091B2

(12) United States Patent
Paulshus et al.

(10) Patent No.: US 7,059,091 B2
(45) Date of Patent: Jun. 13, 2006

(54) TENSION MEMBER

(75) Inventors: Bjørn Paulshus, Skedsmokorset (NO); Roy Olav Kristiansen, Oslo (NO); Zouhair Sahnoun, Oslo (NO)

(73) Assignee: Aker Kvaerner Subsea AS, Lysaker (NO)

( * ) Notice: Subject to any disclaimer, the term of this patent is extended or adjusted under 35 U.S.C. 154(b) by 0 days.

(21) Appl. No.: 09/871,608

(22) Filed: May 31, 2001

(65) Prior Publication Data

US 2002/0028112 A1 Mar. 7, 2002

(30) Foreign Application Priority Data

May 31, 2000 (NO) ..... 20002812

(51) Int. Cl.
*E04C 5/08* (2006.01)

(52) U.S. Cl. ..... 52/223.13; 52/223.14; 52/740.1; 52/730.2; 52/738.1; 57/210; 57/232

(58) Field of Classification Search ..... 52/223.13, 52/223.14, 687, 223.8, 309.16, 210, 211, 52/232, 740.1, 730.1, 730.2, 738; 428/397, 428/377, 374, 373; 385/101, 109, 110, 111, 385/312, 113, 126, 127, 128; 57/210–211, 57/232; 405/224.1
See application file for complete search history.

(56) References Cited

U.S. PATENT DOCUMENTS

| | | | | |
|---|---|---|---|---|
| 1,577,003 | A | | 3/1926 | Sunderland |
| 2,803,486 | A | | 8/1957 | Larson et al. |
| 3,088,269 | A | * | 5/1963 | Shields ..... 428/373 |
| 3,866,273 | A | | 2/1975 | Brandestini et al. |
| 4,068,963 | A | | 1/1978 | Brandestini |
| 4,197,695 | A | * | 4/1980 | Hughes et al. ..... 57/7 |
| 4,275,117 | A | | 6/1981 | Crandall |
| 4,407,770 | A | | 10/1983 | Ripoll |
| 4,498,282 | A | | 2/1985 | Graetz |
| 4,557,007 | A | | 12/1985 | Daiguji et al. |
| 4,594,827 | A | * | 6/1986 | Finsterwalder ..... 52/223.13 |
| 4,612,680 | A | * | 9/1986 | Daiguji ..... 14/22 |
| 4,673,309 | A | | 6/1987 | Schlaich et al. |
| 4,718,965 | A | * | 1/1988 | Finsterwalder et al. ..... 14/22 |
| 4,776,161 | A | | 10/1988 | Sato et al. |
| 4,848,052 | A | * | 7/1989 | Nutzel ..... 52/223.13 |
| 4,960,641 | A | | 10/1990 | Hanaoka et al. |
| 4,999,959 | A | * | 3/1991 | Virtanen ..... 264/228 |
| 5,573,852 | A | | 11/1996 | Thal |
| 5,611,636 | A | | 3/1997 | Flory |
| 6,007,911 | A | | 12/1999 | Bowen, Jr. |

(Continued)

FOREIGN PATENT DOCUMENTS

DE 3731721 * 9/1987

(Continued)

OTHER PUBLICATIONS

Norwegian Search Report of Patent Application No. 2000 2811.

*Primary Examiner*—Carl D. Friedman
*Assistant Examiner*—Chi Q. Nguyen
(74) *Attorney, Agent, or Firm*—Maine & Asmus

(57) ABSTRACT

A tension member comprising a plurality of fiber filaments gathered into a plurality of strands. The filaments run close together, and a protective sheath is provided around the strands. Each strand is coated on the exterior thereof with a strand sheath of a material having a low friction coefficient, permitting the strands to move longitudinally in relation to one another and independently of each other.

9 Claims, 6 Drawing Sheets

U.S. PATENT DOCUMENTS

| | | | | |
|---|---|---|---|---|
| 6,007,912 | A | 12/1999 | Doujak | |
| 6,354,596 | B1 * | 3/2002 | Rodriguez | 174/153 G |
| 6,385,928 | B1 * | 5/2002 | Paulshus et al. | 428/373 |

FOREIGN PATENT DOCUMENTS

| | | | |
|---|---|---|---|
| DE | 3801451 | * | 1/1988 |
| EP | 0428304 | * | 11/1990 |
| EP | 0 672 781 A1 | | 2/1995 |
| EP | 95101891.0 | | 2/1995 |
| EP | 0 685 592 | | 12/1995 |
| EP | 00100815.0 | | 8/2000 |
| EP | 1 029 974 A1 | | 1/2001 |
| GB | 2221936 | * | 8/1989 |
| GB | 9921127.8 | | 3/1998 |
| GB | 2 337 769 A | | 12/1999 |
| JP | 5-118139 | * | 8/1991 |
| NO | 971054 | | 3/1997 |
| NO | 304438 | | 12/1998 |
| WO | PCT/NO98/00076 | | 3/1998 |
| WO | PCT/NO98/00077 | | 3/1998 |
| WO | WO98/39513 | | 9/1998 |
| WO | WO98/39532 | | 9/1998 |

* cited by examiner

TENSION MEMBER

CROSS REFERENCES TO RELATED APPLICATIONS

This application is based upon priority Norwegian Application 2000 2812 filed May 31, 2000.

BACKGROUND OF THE INVENTION

The present invention relates to a tension member intended for use primarily in connection with tension legs for a tension leg platform, but other applications are also relevant, such as in stays or wires for bridges (for example, suspension bridges or inclined strut bridges), anchoring of underwater tunnels, or other uses where there is a need for a light and strong wire or stay. The invention is therefore not limited to the utilization described in the following detailed description.

Tension leg platforms are widely used in drilling and production in oil fields where for various reasons it is not possible or economically justifiable to install a permanent platform, and where it would not be practical to use a floating platform anchored by means of anchors and anchor chains.

The tension leg platforms are in principle floating platforms where, however, instead of a slack anchoring with the aid of anchors and anchor chains, there are tension legs extending from the platform approximately vertically down to an anchor on the seabed. The tension legs are placed under a substantial degree of tension so that, to the extent possible, the platform will be maintained in the same position relative to the seabed. The platform's stable position is a great advantage in both drilling and production. However, this places high demands on the tension legs being used and on their attachment to the platform and their anchoring on the seabed.

The tension legs most widely used today consist of steel tubing in sections. The sections may have unequal lengths, have unequal diameters, and exhibit various wall thicknesses, depending on the size of the platform and the depth of the water. The legs are always constructed as tubes having an air-filled cavity, so that the weight of the leg in the water is greatly reduced. This places a lighter load on the platform. The dimensioning of the leg in relation to external water pressure is therefore a design criterion. These steel legs function well at moderate depths, i.e., depths of a few hundred meters. However, oil and gas production now takes place at increasingly greater depths, possibly up to 2000 meters. Under such conditions there are great demands placed on the strength of the tension legs, and a tension leg of steel would not be usable. The thickness of the wall would then, out of consideration for the increased water pressure, have to be very great, and the pipes would thereby become extremely heavy. For transport reasons they would also have to consist of a great many sections that would need to be joined together during installation. The tension legs would thereby acquire a considerable number of joints, which would also contribute to the substantial weight increase. To counteract the increase in weight, it could be advisable to equip the legs with a large number of buoyancy members. All this would result in an extremely expensive and heavy installation.

Carbon fibers, with their low weight and high tensile strength, have already been put to use in various areas in connection with oil and gas extraction, for example, as hoisting cables at great depths, where the weight of a hoisting cable made of steel would create problems.

It is an aim according to the present invention to exploit the advantageous properties of the carbon fibers, particularly their high strength when subjected to tensile stresses, by utilizing them also in tension legs. However, the carbon fibers do also have one significant negative property: they have very little rupture strength in the face of shearing stresses. In the designing of a tension leg consisting of carbon fibers, this factor would have to be taken into consideration.

From the present applicant's own Norwegian patent 304839 (corresponding to WO 98/39513) there is known a tension member incorporating ideas from the applicant's own pipe bundle cable (umbilical) as described in NO 155826. Here, a plurality of smaller pipelines are laid in a bundle in a manner that allows them axial movement in relation to each other. The cable is not suitable, however, for taking up a high degree of tension.

NO 174940 describes a method and a machine for combining a plurality of elongate pipelines or cables into a cable string (umbilical). This cable string comprises a center tube. Nor in this case is the cable string suitable for absorbing substantial tension.

EP 685 592 describes a method for separating the individual strands in a steel wire in order to prevent wear and to increase the cross section. The plastic elements between the strands will be pressed together when a load is placed on the cable, and will thereby prevent contact between the strands. The strands are not capable of free axial movement in relation to each other due to this compression, or clamping effect.

FR 2078622 also describes a steel wire into which is laid a filler substance to separate the individual wires. Free axial movement of the strands is hampered as direct contact occurs between them.

U.S. Pat. No. 3,088,269 describes a method for manufacturing a steel wire having a smooth surface for use in aerial cableways and the like. The filler elements are inserted between the strands in order to secure them and to hold them apart from one another. There is no possibility of free movement between the strands here, either, since the intention is, quite to the contrary, to achieve a clamping effect between the strands and the elements.

The solution according to the aforementioned Norwegian patent 304839 aimed to provide a tension leg made preferably of carbon fiber, which would be usable for tension leg platforms at great depths, where the carbon fibers were protected against shearing stresses by means of pressure-proof spacing elements having recesses into which the strands were laid individually in a manner permitting them to move in the longitudinal direction unobstructed by one another or by the spacing elements.

Although this solution functions very well, however, the construction is complicated and the manufacture is difficult. The spacing elements also contribute to an enlarged diameter, which is a disadvantage when the tension member is to be coiled up, and to increased weight. Moreover, the spacing elements make the tension member more expensive.

BRIEF SUMMARY OF THE INVENTION

Therefore, one has attempted to arrive at a simpler and less expensive solution. This has been manifested in a tension member of the aforementioned type, where each strand is coated on the exterior thereof with a sheath made of a material having a low friction coefficient, permitting the strands to move longitudinally in relation to one another and independently of each other.

A more detailed explanation of the invention is provided in the following description and appended claims taken in conjunction with the accompanying drawings.

BRIEF DESCRIPTION OF THE DRAWINGS

The invention shall now be described in more detail with reference to the accompanying drawings, where.

DETAILED DESCRIPTION OF THE INVENTION

A detailed description of the preferred embodiments and best modes for practicing the invention are described therein.

Figure 1:
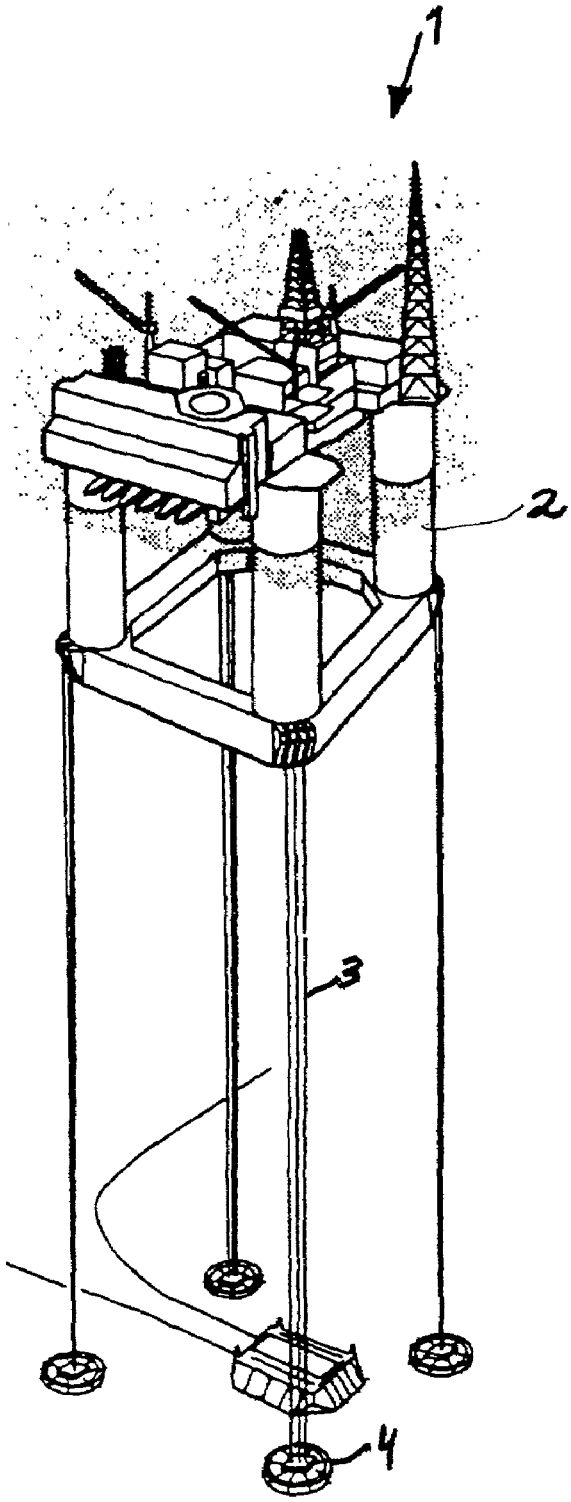
FIG. 1 is a perspective view of a tension leg platform.

FIG. 1 shows a tension leg platform 1. It consists of a floating platform 2, a plurality of tension legs 3 and anchors 4 on the seabed for anchoring the tension legs 3. The tension legs 3 are preferably mounted at the corners of the platform 2 with, for example, three tension legs 3 in each corner. In providing for surplus buoyancy in platform 2, tension legs 3 are placed under substantial tension. For this reason, platform 2 will have very little movement relative to the seabed.

The tension leg is based on the use of carbon fibers. Carbon fiber-based tension legs have numerous advantages over the conventional tension legs consisting of steel tubing. First, they are considerably lighter, having roughly one-fifth of the net weight of the steel, and secondly they can be coiled up for transport.

However, in spite of its high axial strength, carbon fiber is very sensitive to shearing stresses. It is therefore important to protect the fiber filaments against shearing stresses. When the carbon fibers are twisted into strands, it is important that the fiber filaments remain lying in a stable position in relation to each other and do not rub against one another during coiling or use. This can be achieved, for example, by laying the filaments in a tightly packed hexagonal configuration, Warrington Seal, etc. However, one individual strand, if it is to have sufficient strength to be used alone as the tension member in a tension leg, would need to have a considerable diameter and would be so rigid that it would be difficult to coil up. In a tension member for use as a tension leg, therefore, it would be necessary to use several strands, which must be wound around a common longitudinal axis. The filaments in adjacent strands would thus cross over one another and press against each other. This leads to the occurrence of shearing stresses in the outer filaments of the strands. These consequently could rupture, particularly when there is movement between the strands.

Figure 2:
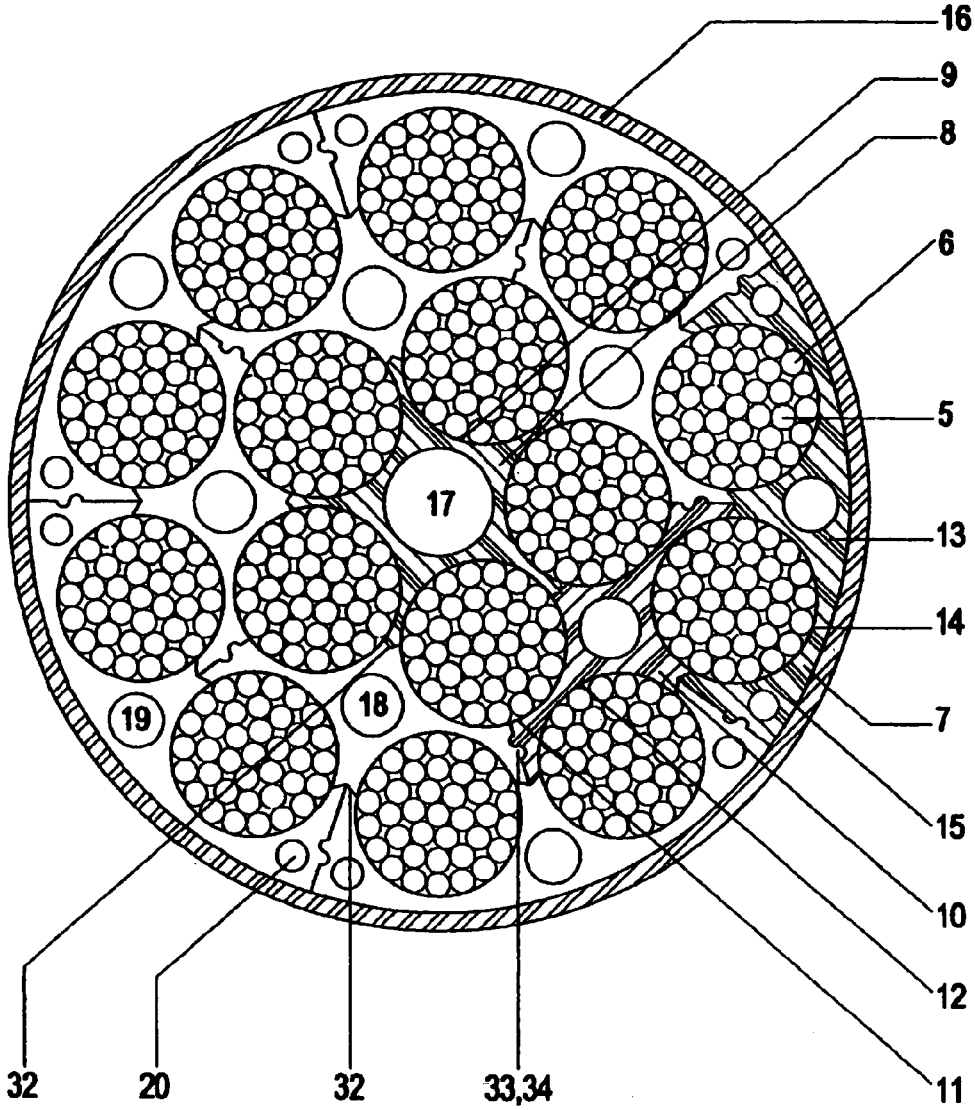
FIG. 2 is a sectional view through a tension member according to NO 304 839.

FIG. 2 shows how a tension member according to the known art is constructed, where the strands are held spaced apart from one another and are permitted to move relative to each other without the occurrence of any rubbing between the filaments. The tension member according to FIG. 2 consists of bundles or strands 5, which in turn consist of a considerable number of single filaments 6. Within each strand 5 the individual filaments 6 are preferably wound around a common center axis. The tension member consists of a plurality of strands 5 that may be positioned in various configurations relative to each other.

Within each strand 5 there is a minimum of movement between the individual filaments 6. Between each strand, however, considerable movements may take place. These movements result in rubbing of the strands against each other. Over time, this will cause the filaments subjected to the stress to rupture and the tension member to be weakened. To avoid this, in accordance with NO 304 839, pressure-proof spacing elements 7 are provided between the strands 5. In spacing elements 7 there are formed recesses 9, 11, 12 and 14 in elements 8, which create longitudinal channels adapted to the shape of a strand 5.

The tension member is provided on the exterior thereof with an encapsulating sheath 16 to hold the spacing elements 7 in place and to protect the tension member against outside influences.

Figure 3:
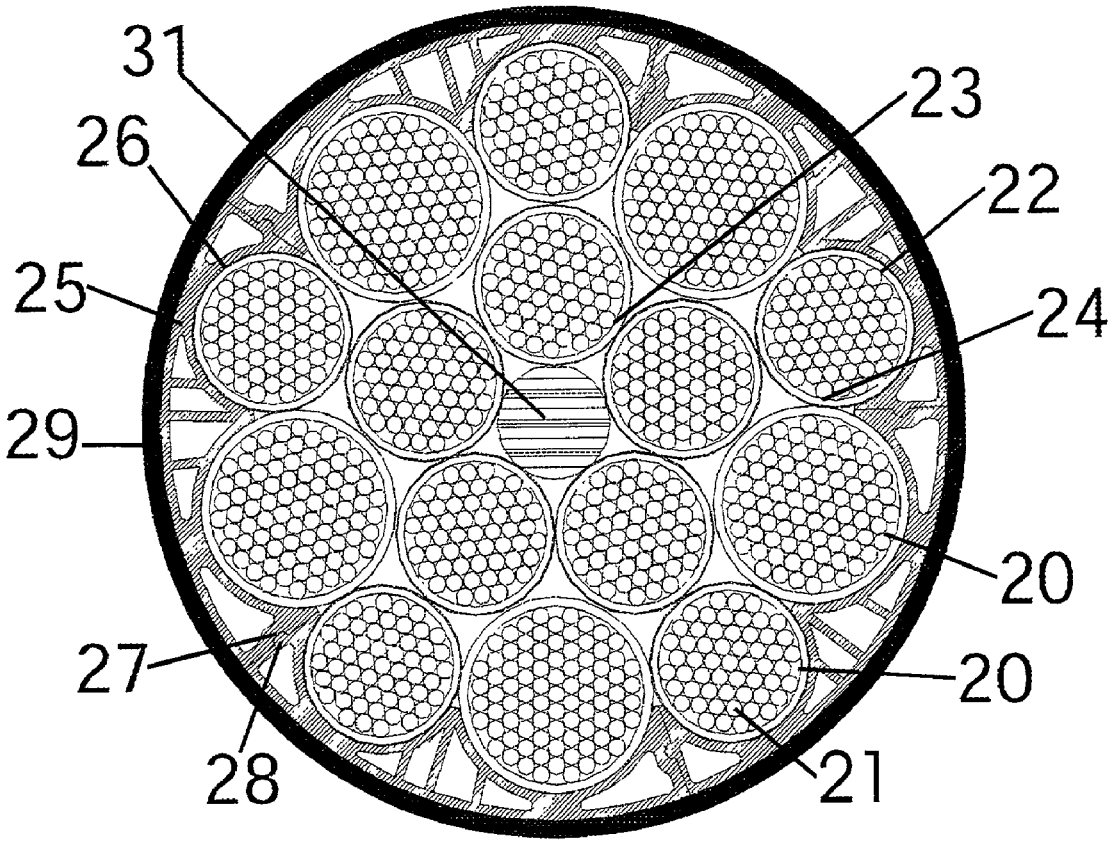
FIG. 3 is a sectional view through a tension member according to a first embodiment of the invention.

In FIG. 3 is shown a first embodiment example of a tension member according to the present invention. Each strand 20 consists of a plurality of composite members (filaments) 21, which are built up in a manner known per se of carbon fibers in a matrix. Each filament may be from 4 to 10 mm thick. Filaments 21 in each strand are wound around each other at a pitch of from 3 to 8 meters.

Around each strand 20 is laid a sheath 22 of a material having low friction coefficient. An appropriate material is, for example, polyethylene (PE), but other materials are also well suited, for example polyurethane (PUR).

After production of the strands and before the tension members are manufactured, the strands are coiled up on a drum having a diameter of between 1 and 2.5 meters. The winding pitch is adapted to the diameter of the drum so that the maximum pitch is equal to the circumference of the drum. With such an adjustment, all the composite filaments will be of equal length around the drum periphery.

In the embodiment form according to FIG. 3, there are laid an inner circle 23 of strands 20 having equal diameter and an outer circle 24 of strands 20 in which every second strand has a large diameter and the alternating strands have a small diameter. The strands 20 having a large diameter are situated in the spaces between the strands in inner circle 23, and the strands 20 of small diameter occupy a position directly outside strands 20 in the inner circle. In this way, the cross section of the tension member is utilized to the maximum with the greatest possible number of composite filaments 21.

In the core of the tension member is placed a filler element 31, which may consist of PVC, and which has the function of forming a support for the strands in inner circle 23.

Outside the outer circle 24 are placed a plurality of spacing elements 25, each of which is provided with a recess 26 having a curvature adapted to the outer circumference of the adjacent strand 20. Spacing elements 25 are equipped with corresponding locking elements 27 and 28, which engage with one another and ensure that the spacing elements 25 are held in place with respect to each other. The spacing elements serve to create a distance between strands 20 and an outer protective sheath 29 and ensure that the outer circumference of the tension member will be round. The spacing elements also protect strands 20 against impact and prevent the protective sheath from squeezing the strands together. When protective sheath 29 is laid around the spacing elements, these are pressed hard against each other on their adjoining sides; but because of locking elements 27 and 28, the spacing elements 25 cannot be displaced with respect to each other in a radial direction and thereby form a barrier against the strands 20 within.

Strands 20 preferably lie close together, but without any appreciable pressure on one another, which permits them to move unhindered longitudinally in relation to each other. There may well be a certain clearance, however, between the strands in the outer circle 24 and the spacing elements.

The outer protective sheath 29 is preferably made of polyethylene (PE), whereas spacing elements 25 consist preferably of polyvinyl chloride (PVC).

Figure 4:
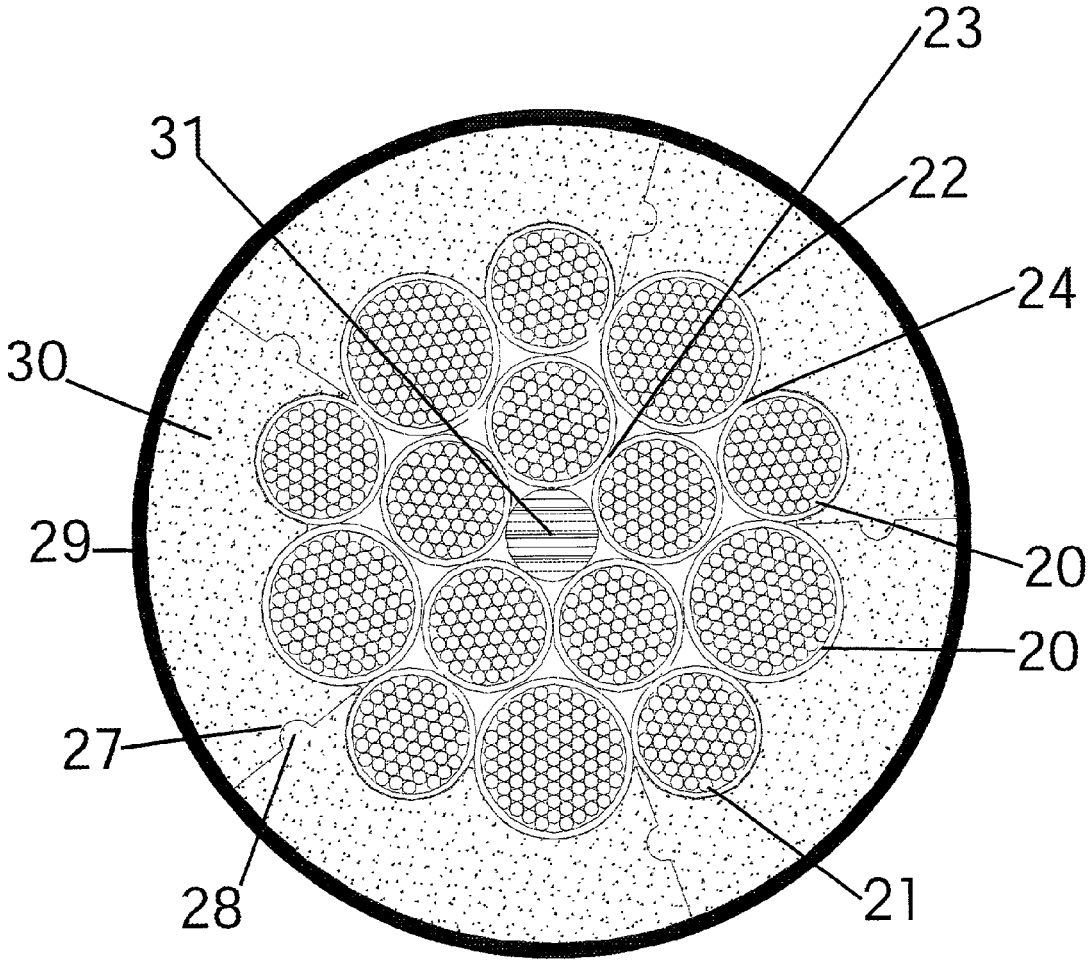
FIG. 4 is a sectional view through a tension member according to a second embodiment of the invention.

In FIG. 4 is shown a second embodiment form of the tension member according to the present invention. Here, the strands 20 are arranged in the same manner as in FIG. 3, in an inner circle 23 and an outer circle 24. Instead of spacing elements 25, however, there are provided spacing elements 30 of a material having buoyancy in water, for example a syntactic foam. In the same way as for spacing elements 25, the spacing elements 30 are equipped with complementary locking elements 27 and 28 on their adjoining surfaces. When the outer protective sheath 29 is laid with pressure around spacing elements 30, these are pressed tightly against each other, but prevent strands 20 that lie within from being compressed against each other.

The embodiment forms according to FIGS. 3 and 4 have five strands in the inner circle. However, there may also be arranged more or fewer strands in this circle. If six strands are positioned here, there will be space for one strand of the same diameter in the core of the tension member instead of filler element 31. Alternatively, one strand of a smaller diameter may be positioned in the core if five strands are placed around it.

Figure 5:
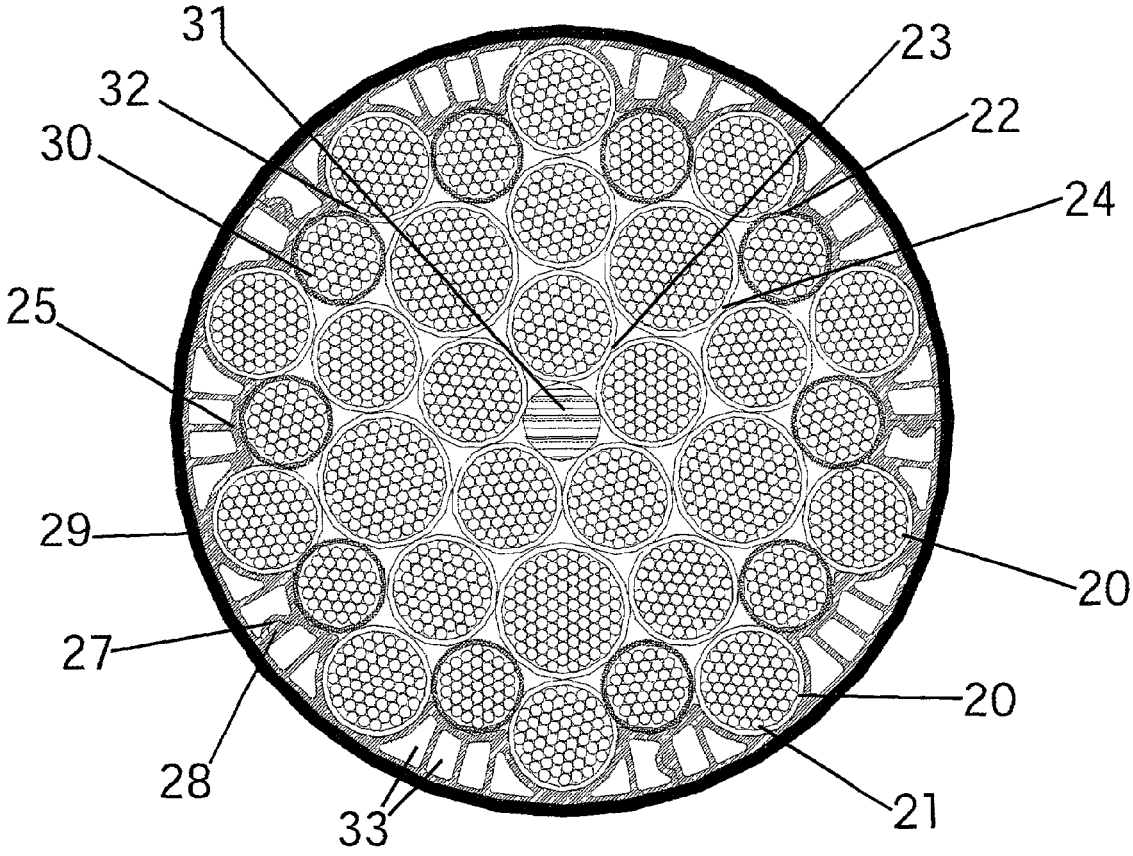
FIG. 5 is a sectional view through a tension member according to a third embodiment of the invention.

In FIG. 5 is shown a third embodiment form of the present invention. Here the strands 20 are arranged in three circles. The two innermost circles 23 and 24 are similar to the circles in the embodiment forms according to FIGS. 3 and 4. Outside these there is arranged a third circle 32 of strands 20. Here there are placed strands 20 having alternating small and large diameters. The strands 20 having a small diameter are arranged in the intermediate spaces between the strands in inner circle 24, whereas the strands 20 of large diameter are disposed directly outside strands 20 of inner circle 24.

Outside the third circle 32 of strands 20 are placed spacing elements 25, which are of the same type as spacing elements 25 in FIG. 3. Spacing elements 25 according to FIG. 3 or FIG. 5 are provided with cavities 33 which lighten the weight of the tension member.

Figure 6:
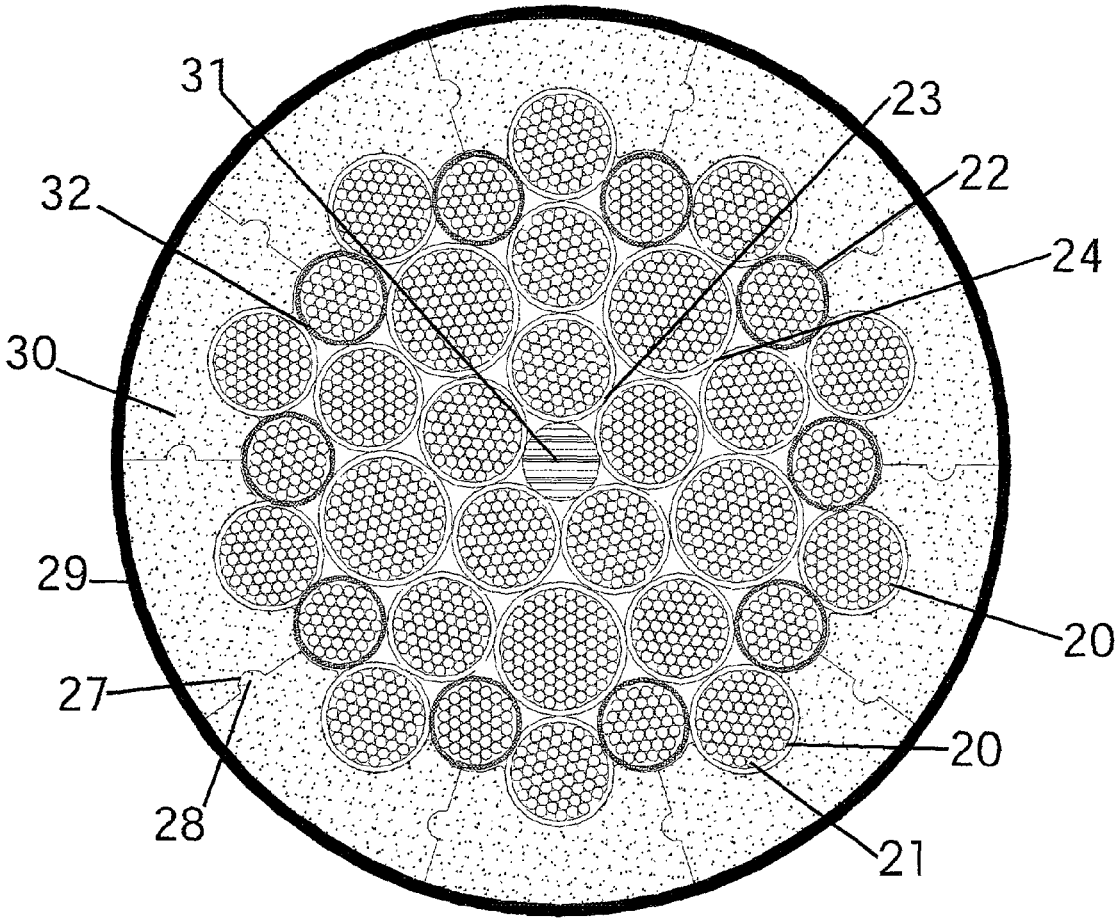

FIG. 6 shows a fourth embodiment form having strands 20 distributed in three circles in the same manner as in the embodiment form according to FIG. 5. The tension member according to this embodiment form, however, is provided with spacing elements 30 of a material having buoyancy in water, for example, a syntactic foam, in the same manner as in the embodiment form according to FIG. 4.

Strands 20 are preferably wound about the core of the tension member at a pitch of 10–50 meters. After its manufacture, the tension member is coiled up on a drum having a diameter of between 4 and 16 meters. The winding of the strands is adapted to the diameter of the drum such that the maximum pitch is equal to the circumference of the drum. When adjusted in this way, all the strands will be of equal length around the periphery of the drum.

The invention is not limited to the illustrated configurations of strands, as it comprises any conceivable distribution of the strands that can be utilized in practice.

Instead of arranging buoyancy members inside the protective sheath 29, as shown with spacing elements 30, one can place these on the outside of sheath 29.

The invention is thus limited only by the following independent patent claims.

Although embodiments of the invention have been shown and described, it is to be understood that various modifications, substitutions and rearrangements of parts and components can be made by those skilled in the art without departing from the novel spirit and scope of the invention.

The invention claimed is:

1. A tension member, comprising a plurality of fiber filaments gathered into a plurality of strands in which the filaments run close together, around which strands there is provided a protective sheath, wherein between the strands and the protective sheath there are provided spacing elements, which spacing elements define an inner continuous cavity adapted to receive a plurality of strands, said cavity having a cross section corresponding to, at least, approximately the total cross section of all the strands, and that each strand is coated on the exterior thereof with a strand sheath of a material having a low friction coefficient, permitting the strands to move longitudinally in relation to one another and independently of each other.

2. The tension member according to claim 1, wherein the strand sheath consists of polyethylene or polyurethane.

3. The tension member according to claim 1, wherein the spacing elements are provided with recesses, which recesses are adapted to the cross-sectional form of the adjacent strands.

4. The tension member according to claim 3, wherein the spacing elements are equipped with complementary locking elements on their adjoining surfaces.

5. The tension member according to claim 1, wherein at least one of the spacing elements comprises a material having buoyancy in water.

6. The tension member according to claim 1, wherein the spacing elements consist of PVC.

7. The tension member according to claim 1, wherein the spacing elements consist of a material having buoyancy in water.

8. The tension member according to claim 1, wherein the filaments are wound at a pitch corresponding to the circumference of a drum onto which the strands are to be coiled.

9. The tension member according to claim 1, wherein the strands are wound at a pitch corresponding to the circumference of a drum onto which the tension member is to be coiled.

* * * * *